US010786823B2

(12) United States Patent
Clark et al.

(10) Patent No.: US 10,786,823 B2
(45) **Date of Patent: *Sep. 29, 2020**

(54) REVERSING MECHANISM FOR AN IRRIGATION SPRINKLER WITH A REVERSING GEAR DRIVE

(71) Applicant: Hunter Industries, Inc., San Marcos, CA (US)

(72) Inventors: Michael L. Clark, San Marcos, CA (US); Zachary B. Simmons, Escondido, CA (US)

(73) Assignee: Hunter Industries, Inc., San Marcos, CA (US)

( * ) Notice: Subject to any disclaimer, the term of this patent is extended or adjusted under 35 U.S.C. 154(b) by 131 days.

This patent is subject to a terminal disclaimer.

(21) Appl. No.: 16/158,139

(22) Filed: Oct. 11, 2018

(65) Prior Publication Data

US 2019/0076858 A1 Mar. 14, 2019

Related U.S. Application Data

(63) Continuation of application No. 14/801,654, filed on Jul. 16, 2015, now Pat. No. 10,099,231.

(51) Int. Cl.
*B05B 3/04* (2006.01)
*B05B 15/74* (2018.01)

(52) U.S. Cl.
CPC ..... *B05B 3/0431* (2013.01); *B05B 15/74* (2018.02)

(58) Field of Classification Search
CPC ..... B05B 15/10; B05B 3/04; B05B 3/0418; B05B 3/0422; B05B 3/0431; A01G 25/00
See application file for complete search history.

(56) References Cited

U.S. PATENT DOCUMENTS

| | | | |
|---|---|---|---|
| 5,058,806 | A | 10/1991 | Rupar |
| 5,288,022 | A | 2/1994 | Sesser |
| 5,375,768 | A | 12/1994 | Clark |
| 5,423,486 | A | 6/1995 | Hunter |
| 5,456,411 | A | 10/1995 | Scott et al. |
| 5,556,036 | A | 9/1996 | Chase |
| 5,699,962 | A | 12/1997 | Scott et al. |
| 5,711,486 | A | 1/1998 | Clark et al. |
| 5,720,435 | A | 2/1998 | Hunter |
| 5,762,270 | A | 6/1998 | Kearby et al. |
| 5,918,812 | A | 7/1999 | Beutler |
| 5,927,607 | A | 7/1999 | Scott |
| 5,988,523 | A | 11/1999 | Scott |
| 6,042,021 | A | 3/2000 | Clark |
| 6,050,502 | A | 4/2000 | Clark |
| 6,082,632 | A | 7/2000 | Clark et al. |
| 6,138,924 | A | 10/2000 | Hunter et al. |
| 6,227,455 | B1 | 5/2001 | Scott et al. |
| 6,241,158 | B1 | 6/2001 | Clark et al. |
| 6,244,521 | B1 | 6/2001 | Sesser |

(Continued)

*Primary Examiner* — Christopher S Kim
(74) *Attorney, Agent, or Firm* — Knobbe Martens Olson & Bear, LLP

(57) ABSTRACT

A sprinkler can include a turbine, a nozzle, a gear drive and a reversing mechanism. The gear drive and the reversing mechanism rotatably couple the turbine and the nozzle. The gear drive can shift a direction of rotation of an output stage that is coupled to the reversing mechanism. The reversing mechanism can include a shift member coupled with the gear drive.

20 Claims, 15 Drawing Sheets

(56) References Cited

U.S. PATENT DOCUMENTS

| | | | |
|---|---|---|---|
| 6,299,075 | B1 | 10/2001 | Koller |
| 6,457,656 | B1 | 10/2002 | Scott |
| 6,491,235 | B1 | 12/2002 | Scott et al. |
| 6,499,672 | B1 | 12/2002 | Sesser |
| 6,651,905 | B2 | 11/2003 | Sesser et al. |
| 6,688,539 | B2 | 2/2004 | Vander Griend |
| 6,695,223 | B2 | 2/2004 | Beutler et al. |
| 6,732,950 | B2 | 5/2004 | Ingham et al. |
| 6,736,332 | B2 | 5/2004 | Sesser et al. |
| 6,817,543 | B2 | 11/2004 | Clark |
| 6,854,664 | B2 | 2/2005 | Smith |
| 6,869,026 | B2 | 3/2005 | McKenzie et al. |
| 6,871,795 | B2 | 3/2005 | Anuskiewicz |
| 6,945,471 | B2 | 9/2005 | McKenzie et al. |
| 6,957,782 | B2 | 10/2005 | Clark et al. |
| 7,032,836 | B2 | 4/2006 | Sesser et al. |
| 7,040,553 | B2 | 5/2006 | Clark |
| 7,159,795 | B2 | 1/2007 | Sesser et al. |
| 7,240,860 | B2 | 7/2007 | Vander Griend |
| 7,287,711 | B2 | 10/2007 | Crooks |
| 7,303,147 | B1 | 12/2007 | Danner et al. |
| 7,322,533 | B2 | 1/2008 | Grizzle |
| D593,182 | S | 5/2009 | Anuskiewicz |
| 7,530,504 | B1 | 5/2009 | Danner et al. |
| 7,611,077 | B2 | 11/2009 | Sesser et al. |
| 7,621,467 | B1 | 11/2009 | Garcia |
| 7,677,469 | B1 | 3/2010 | Clark |
| 7,748,646 | B2 | 7/2010 | Clark |
| 7,828,230 | B1 | 11/2010 | Anuskiewicz et al. |
| 7,861,948 | B1 | 1/2011 | Crooks |
| 8,469,288 | B1 | 6/2013 | Clark et al. |
| 8,939,384 | B1 | 1/2015 | Anuskiewicz |
| 10,099,231 | B2 * | 10/2018 | Clark ..... B05B 15/74 |
| 2005/0133619 | A1 | 6/2005 | Clark |
| 2009/0224070 | A1 | 9/2009 | Clark et al. |
| 2011/0024522 | A1 | 2/2011 | Anuskiewicz |

* cited by examiner

REVERSING MECHANISM FOR AN IRRIGATION SPRINKLER WITH A REVERSING GEAR DRIVE

CROSS-REFERENCE TO RELATED APPLICATION

This application is a continuation application of U.S. patent application Ser. No. 14/801,654, filed Jul. 16, 2015, and entitled "REVERSING MECHANISM FOR AN IRRIGATION SPRINKLER WITH A REVERSING GEAR DRIVE." This application is also related to U.S. patent application Ser. No. 13/925,578, filed Jun. 24, 2013, now U.S. Pat. No. 8,955,768, to U.S. patent application Ser. No. 12/710,265, filed Feb. 22, 2010, now U.S. Pat. No. 8,469,288, and to U.S. patent application Ser. No. 11/761,911 filed Jun. 12, 2007, now U.S. Pat. No. 7,677,469. The entire contents of the above applications are hereby incorporated by reference and made a part of this specification. Any and all priority claims identified in the Application Data Sheet, or any correction thereto, are hereby incorporated by reference under 37 CFR § 1.57.

FIELD OF THE INVENTIONS

The present inventions relate to apparatus for irrigating turf and landscaping, and more particularly, to rotor-type sprinklers having a turbine that rotates a nozzle through a gear train reduction.

BACKGROUND OF THE INVENTIONS

In many parts of the United States, rainfall is insufficient and/or too irregular to keep turf and landscaping green and therefore irrigation systems are installed. Such systems typically include a plurality of underground pipes connected to sprinklers and valves, the latter being controlled by an electronic irrigation controller. One of the most popular types of sprinklers is a pop-up rotor-type sprinkler. In this type of sprinkler a tubular riser is normally retracted into an outer cylindrical case by a coil spring. The case is buried in the ground and when pressurized water is fed to the sprinkler the riser extends. A turbine and a gear train reduction are mounted in the riser for rotating a nozzle turret at the top of the riser. The gear train reduction is often encased in its own housing and is often referred to as a gear box. A reversing mechanism is also normally mounted in the riser along with an arc adjustment mechanism.

The gear drive of a rotor-type sprinkler can include a series of staggered gears and shafts wherein a small gear on the top of the turbine shaft drives a large gear on the lower end of an adjacent second shaft. Another small gear on the top of the second shaft drives a large gear on the lower end of a third shaft, and so on. Alternately, the gear drive can comprise a planetary arrangement in which a central shaft carries a sun gear that simultaneously drives several planetary gears on rotating circular partitions or stages that transmit reduced speed rotary motion to a succession of similar rotating stages. It is common for the planetary gears of the stages to engage corresponding ring gears formed on the inner surface of the housing. See, for example, U.S. Pat. No. 5,662,545 granted to Zimmerman et al.

Two basic types of reversing mechanisms have been employed in commercial rotor-type sprinklers. In one design a reversing stator switches water jets that alternately drive the turbine from opposite sides to reverse the rotation of the turbine and the gear drive. See for example, U.S. Pat. No. 4,625,914 granted to Sexton et al. The reversing stator design typically employs a long metal shaft that can twist relative to components rigidly mounted on the shaft and undesirably change the reverse point. Stopping the rotation of the stator and changing direction of rotation via alternate water jets does not provide for good repeatable arc shift points. Users setting the arc of sprinklers that employ a reversing stator design do not get a tactile feel for a stop at the set reverse points.

A more popular design for the reversing mechanism of a rotor-type sprinkler includes four pinion gears meshed together and mounted between arc-shaped upper and lower frames that rock back and forth with the aid of Omega-shaped over-center springs. One of the inner pinion gears is driven by the gear drive and the pinion gears on opposite ends of the frames alternately engage a bull gear assembly. See for example, U.S. Pat. Nos. 3,107,056; 4,568,024; 4,624,412; 4,718,605; and 4,948,052, all granted to Edwin J. Hunter, the founder of Hunter Industries, Inc. The entire disclosures of said patents are hereby incorporated by reference. While the reversing frame design has been enormously successful, it is not without its own shortcomings. It involves a complicated assembly with many parts and can have operational failures. The main drawback of the reversing frame design is that the pinion gears are held in contact to the outer bull gear with a spring force that is relatively weak. Therefore, it is not uncommon for the pinion gears to break, wear out, or become stripped during operation of this kind of rotor-type sprinkler.

Non-reversing, full circle rotation sprinklers such as golf rotors and stream sprinklers have been commercialized that have incorporated planetary gear boxes. Rotor-type sprinklers have also been commercialized that have combined planetary gear boxes and reversing mechanisms, however, in all such sprinklers all parts of the reversing mechanisms have been external to the gear box. See for example, U.S. Pat. No. 4,892,252 granted to Bruniga.

SUMMARY OF THE INVENTIONS

According some embodiments, a sprinkler can include a turbine, a nozzle, a gear drive and a reversing mechanism. The gear drive and reversing mechanism can rotatably couple the turbine and the nozzle. The gear drive and reversing mechanism can be coupled to shift a direction of rotation of an output stage of the gear drive. In some embodiments, the gear drive can include a control shaft that is axially movable to shift a direction of rotation of an output stage that is coupled to the reversing mechanism. The reversing mechanism can include a shift member secured to an upper end of the control shaft. The reversing mechanism can further include a mechanism to move the control shaft from a first position to a second position. In some embodiments, the control shaft may include a drive clutch. The gear drive may have two drive gears that alternately engage with the drive clutch.

According to some variants, a sprinkler can include a turbine, a nozzle, and/or a gear drive. In some embodiments, the sprinkler includes a reversing mechanism rotatably coupling the turbine and the nozzle. The gear drive can include at least a portion of the reversing mechanism having a shifting drive shaft that reciprocates between raised and lowered positions to alternately engage different drive gears that are coupled to non-shifting gears and thereby change a direction of rotation of subsequent stages of the planetary gear drive. In some embodiments, the sprinkler includes at least one clutch dog connected to the drive shaft. The at least one clutch dog can be configured to selectively engage with at least one clutch tooth formed on two or more of the different drive gears.

In some configurations, the sprinkler includes a riser enclosing the gear drive, an outer case surrounding the riser, and/or a coil spring surrounding the riser and normally holding the riser in a retracted position within the case and compressible to allow the riser to telescope to an extended position when pressurized water is introduced into the case.

In some configurations, the nozzle is carried inside a nozzle turret rotatably mounted at the upper end of the riser.

In some configurations, the reversing mechanism includes a shift member connected to the shifting drive shaft. In some embodiments, the reversing mechanism includes a pivotable shift fork with a first cam and a second cam spaced from the first cam. The first cam can be configured to engage the shift member and raise the shifting drive shaft when the shift fork is pivoted to engage the first cam with the shift member. The second cam can be configured to engage the shift member and lower the shifting drive shaft when the first fork is pivoted to engage the second cam with the shift member. In some embodiments, the reversing mechanism includes a housing and a shift crank pivotally supporting the shift fork in the housing.

In some configurations, the reversing mechanism further includes an over-center spring biasing the shift fork so that either the first cam or the second cam is engaged with the shift member.

In some configurations, the over-center spring is a coil spring having a first end connected to the housing and a second end connected to the shift crank.

In some configurations, the sprinkler includes a shift toggle extending from the housing, the shift toggle being connected to the shift crank.

In some configurations, the sprinkler further includes a fixed arc tab extending from a gear box housing of the gear drive in a predetermined location so that the fixed arc tab can be engaged by the shift toggle as the housing is rotated by the gear drive to pivot the shift fork to cause one of the first and second cams to engage the shift member.

In some configurations, the sprinkler further comprises a nozzle turret carrying the nozzle, a carrier ring coupled to the nozzle turret and rotatable relative to the housing, a bull gear ring coupled to the carrier ring, and/or an adjustable arc tab extending from the carrier ring in a predetermined location so that the adjustable arc tab can be engaged by the shift toggle as the housing is rotated by the gear drive to pivot the shift fork to cause the other one of the first and second cams to engage the shift member.

According to some variants, a sprinkler can include a nozzle. The sprinkler can include a gear drive with an output stage and a control shaft. In some embodiments, a direction of rotation of the output stage is reversible by axial motion of the control shaft. In some embodiments, the sprinkler includes a turbine coupled to an input stage of the gear drive. In some cases, the sprinkler includes a reversing mechanism coupled between the output stage of the gear drive and the nozzle. The reversing mechanism can include a pair of cams that alternately engage a shift member connected to the control shaft. In some embodiments, the sprinkler includes a shifting drive clutch connected to the control shaft and configured to alternately rotatably lock with at least two separate gears of the gear drive.

In some configurations, the drive member has a barrel shape.

In some configurations, the cams are formed on a pivotable shift fork.

In some configurations, the shift fork is pivotally mounted within a housing on a shift crank.

In some configurations, the shift crank is pivotable by moving a shift toggle when it engages a pair of arc tabs.

In some configurations, the sprinkler includes an over-center spring connected between the housing and the shift crank.

In some configurations, each cam has a sloped surface.

In some configurations, the sprinkler includes a nozzle turret that encloses the nozzle and is coupled to the reversing mechanism. The reversing mechanism can be partially mounted in the nozzle turret for moving an adjustable arc tab.

In some configurations, the sprinkler can include a fixed arc tab connected to a gear box of the gear drive.

According to some variants, a sprinkler includes a riser, a gear drive mounted inside the riser, a turbine coupled to an input shaft of the gear drive, and/or a nozzle turret. The sprinkler can include a reversing mechanism coupling an output stage of the gear drive and the nozzle turret that axially shifts a drive clutch within the gear drive to change a direction of rotation of the output stage.

DETAILED DESCRIPTION OF THE PREFERRED EMBODIMENT

Irrigation sprinklers can be used to distribute water to turf and other landscaping. Types of irrigations sprinklers include pop-up, rotor-type, impact, spray and/or rotary-stream sprinklers. In some applications, such as that shown in FIG. 1, an irrigation system 2 can include multiple irrigation sprinklers 1 used to water a targeted area. One or more controllers (e.g., wireless and/or wired controllers) can be used to control the operation of multiple irrigation sprinklers. For example, one or more controllers can control when each of the sprinklers of the irrigation system transitions between an irrigating (e.g., ON) configuration and a non-irrigating (e.g., OFF) configuration. In some embodiments, the one or more controllers control the amount of water distributed by the sprinklers. The water source 9 for the irrigation system can be provided by a single water source, such as a well, a body of water, or water utility system. In some applications, multiple water sources are used.

Figure 1:
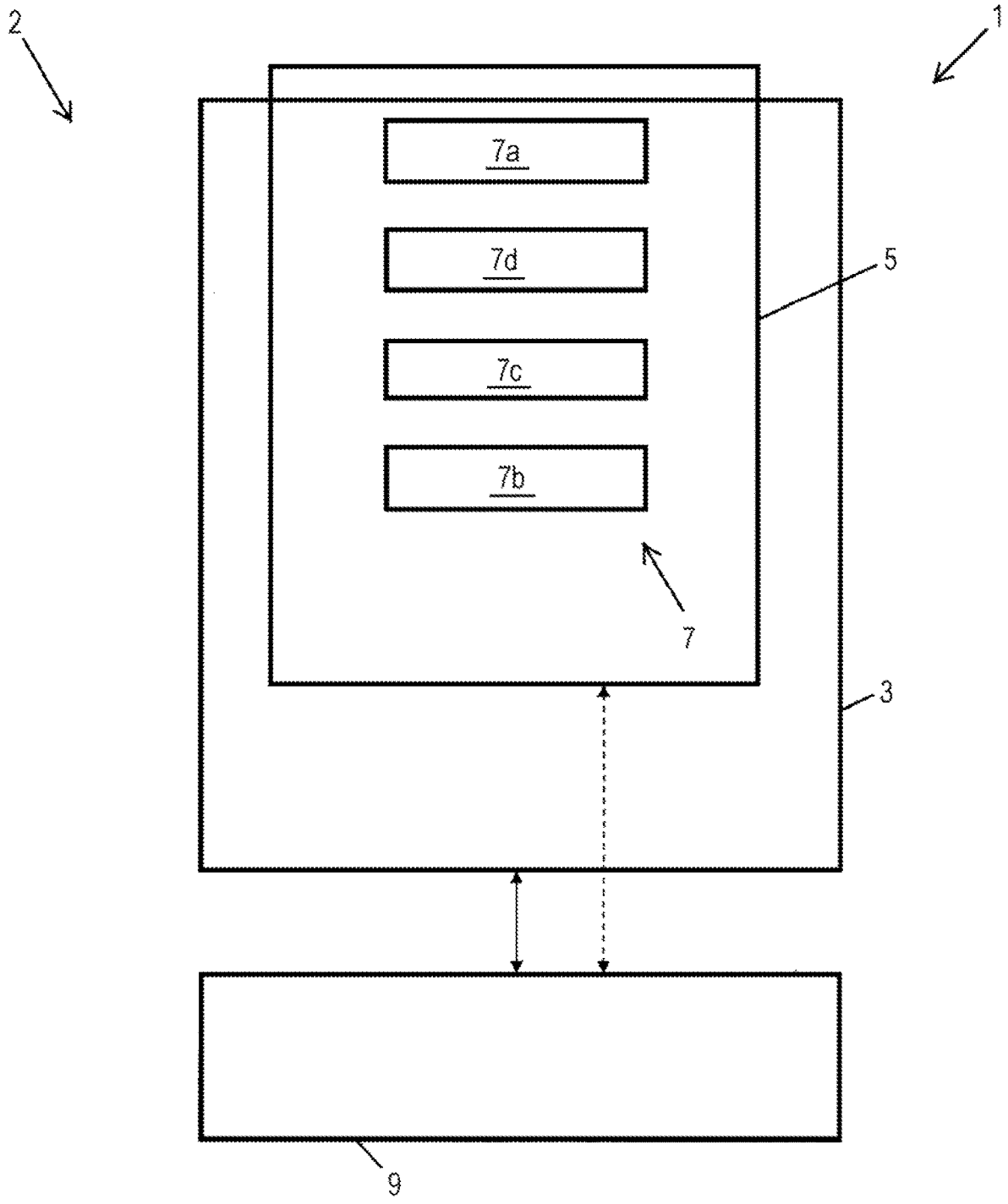
FIG. 1 is a schematic illustration of an irrigation sprinkler.

As schematically illustrated in FIG. 1, an irrigation sprinkler 1 can include an outer case 3. The outer case 3 can have a generally cylindrical shape or some other appropriate shape. A riser 5 can be positioned at least partially within the outer case 3. In some embodiments, such as pop-up sprinklers, the riser 5 is biased to a contracted or non-irrigating position within the outer case 3. The riser 5 may be biased to the contracted position by gravity and/or biasing structures such as springs. In some embodiments, the riser 5 transitions to an extended or irrigating position when pressure (e.g., water pressure) within the outer case 3 is high enough to overcome a biasing force on the riser 5. In some embodiments (e.g., non-pop-up sprinklers) the riser 5 is fixed in the extended position.

One or more mechanical components 7 can be positioned within the riser 5 and/or within the outer case 3. For example, the riser 5 can include an outlet 7*a* (e.g., a nozzle or outlet port). In some embodiments, the sprinkler 1 includes a plurality of outlets. The outlet 7*a* can direct water from the irrigation sprinkler 1 when the sprinkler 1 is ON. In some embodiments, the outlet 7*a* is connected to an outlet housing (e.g., a nozzle turret). The outlet housing and/or outlet 7*a* can be rotatable or otherwise moveable with respect to the riser 5 and/or outer case 3.

In some embodiments, the irrigation sprinkler 1 includes a turbine 7*b*. The turbine 7*b* can rotate in response to water entering an inlet end of the riser 5 and/or the outer case 3. The turbine 7*b* can be configured to rotate the outlet 7*a*. In some embodiments, a gear train reduction 7*c* is connected to the turbine 7*b* via an input shaft or otherwise. The gear train reduction 7*c* ca transfer torque from the rotating turbine 7*b* to the outlet housing and/or outlet 7*a* via an output shaft, output clutch, or other output structure.

The sprinkler 1 can include a reversing mechanism 7*d*. The reversing mechanism 7*d* can be positioned within the riser 5 and/or within the outer case 3. In some embodiments, the reversing mechanism 7*d* is connected to the gear train reduction 7*c* and/or to the outlet 7*a*. The reversing mechanism 7*d* can be used to reverse the direction of rotation of the outlet 7*a*. In some embodiments, the reversing mechanism 7*d* reverses the direction of rotation of the outlet 7*a* without changing the direction of rotation of the turret 7*b*. In some embodiments, the reversing mechanism 7*d* reverses the direction of rotation of the outlet 7*a* by reversing the direction of rotation of the turret 7*b*.

In some embodiments, the reversing mechanism 7*d* reverses the direction of rotation of the outlet 7*a* via manual input. For example, a tool may be used to adjust the reversing mechanism 7*d* to reverse the direction of rotation of the outlet 7*a*. In some embodiments, the reversing mechanism 7*d* reverses the direction of rotation of the outlet 7*a* automatically via selected arc limiters. In some cases, at least one of the selected arc limiters can be adjusted to a desired position.

Water may be provided to the sprinkler 1 via one or more water sources 9. The water source 9 may be fluidly connected to the outer case 3 and/or to the riser 5. In some embodiments, fluid communication between the water source 9 and the sprinkler 1 is controlled by one or more controllers, valves, or other apparatuses.

According to the present disclosure, a rotor-type sprinkler can include an outer case with a top portion and a bottom portion. A valve can be incorporated in the outer case (e.g., near the bottom of the outer case). The valve can selectively permit ingress of water into the rotor-type sprinkler. The rotor-type sprinkler can include a turbine configured to rotate in response to the ingress of water. A nozzle of the rotor-type sprinkler can be configured to rotate in response to rotation of the turbine. A gear drive can be positioned within the outer case to provide gear reduction between the turbine and the nozzle. In some embodiments, the gear drive is a reversing gear drive configured to selectively reverse the rotation of the nozzle. The rotor-type sprinkler can also include a reversing mechanism configured to reverse the rotation of an output stage of the gear drive. The reversing mechanism can be located externally of the reversing gear drive.

Figure 12:
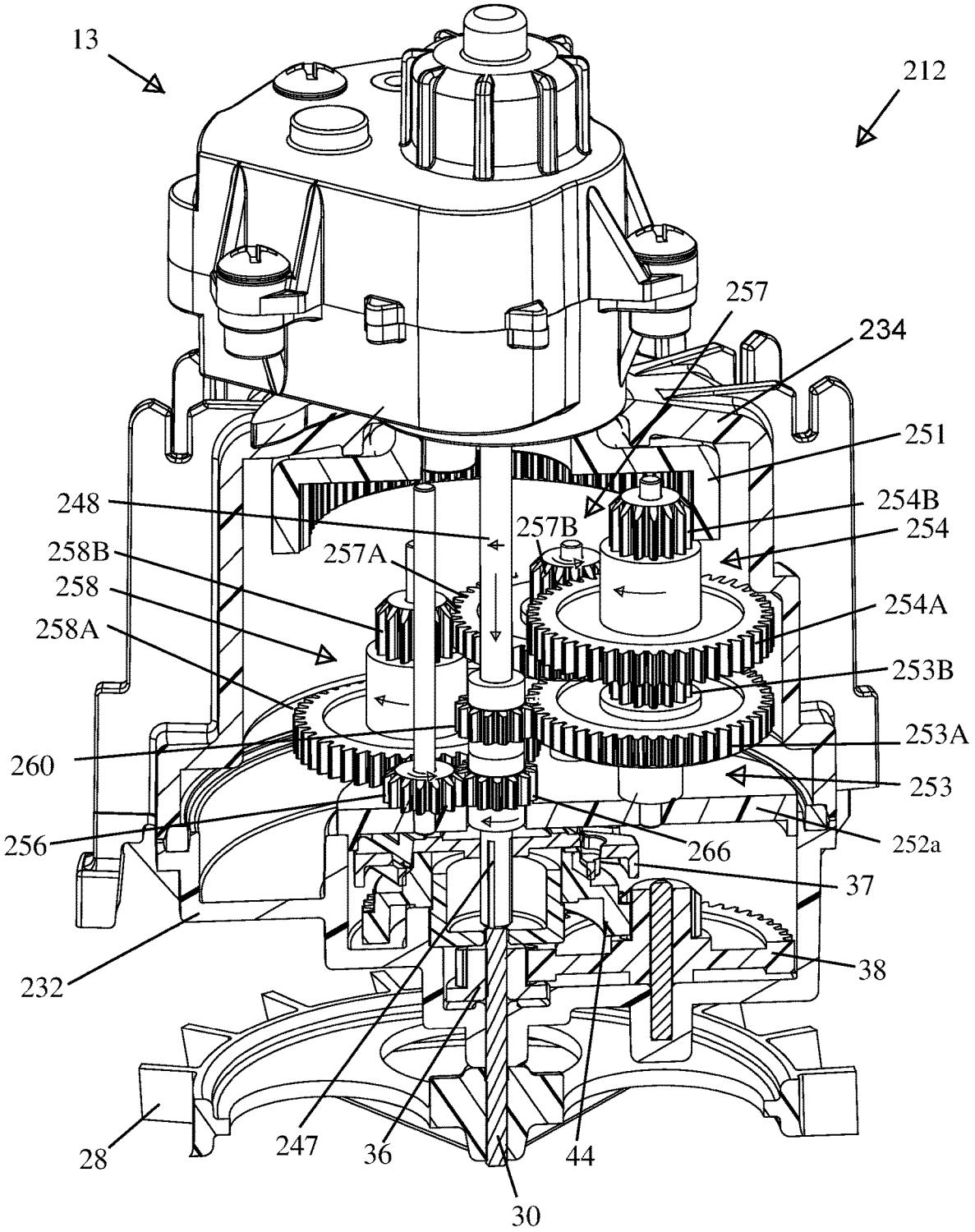
FIG. 12 illustrates a reversing gear drive incorporating another embodiment the present inventions in a forward operating configuration.

In some embodiments, a reversing mechanism can be operatively connected to one or more gears in a reversing gear drive. The reversing mechanism can transition to engage the one or more gears between a plurality of operating positions/configurations to affect, for example, the rotational direction of the nozzle. The reversing gear drive can have any number of different configurations, a few examples of which are described below. For example, the reversing gear drive can be a reversing planetary gear drive 12 (FIG. 2) or a reversing spur gear drive 212 (FIG. 12). Other drive systems can also be used.

As illustrated and described below, the reversing gear drive can include a clutch. The clutch can be configured to move in an axial direction (e.g., substantially parallel to the axis of rotation of the turbine) between two or more operative positions. For example, the clutch can be configured to transition between an upper operative position and a lower operative position. The clutch can engage with an upper drive gear when in the upper operative position. The upper drive gear can be configured to drive one or more the remaining gears in the gear drive to rotate the nozzle in a first direction in response to rotational input from the drive gear/turbine. The clutch can engage with a lower drive gear when in the lower operative position. The lower gear can be configured to drive one or more of the remaining in gears in the gear drive to rotate the nozzle in a second direction (e.g., opposite the first direction) in response to rotational input from the lower drive gear/turbine. In some embodiments, the one or more remaining gears driven by the upper and lower drive gears share one or more gears and/or gear shafts.

Figure 1A:
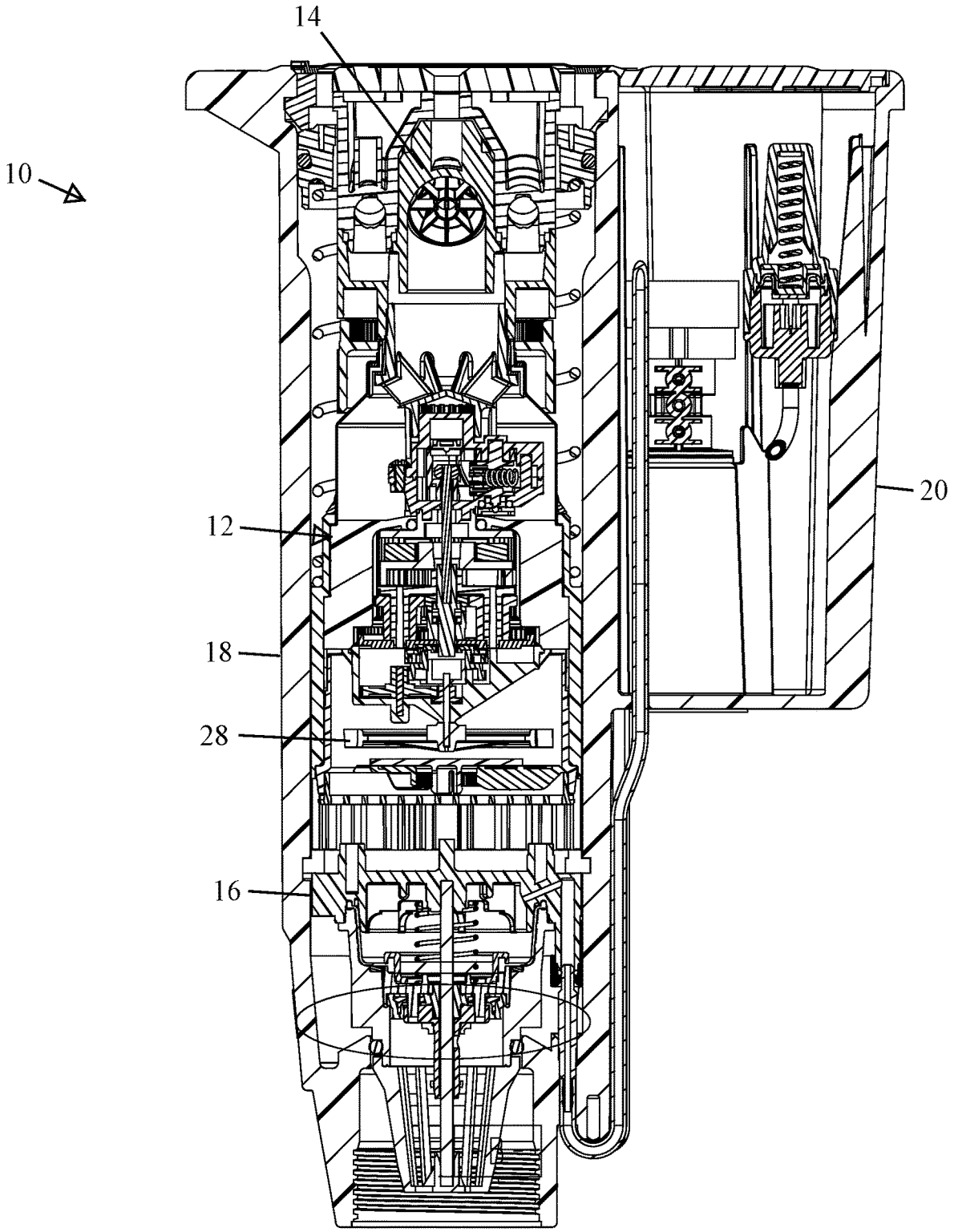
FIG. 1A is a vertical sectional view of a rotor-type sprinkler incorporating an embodiment of the present inventions.
Figure 2:
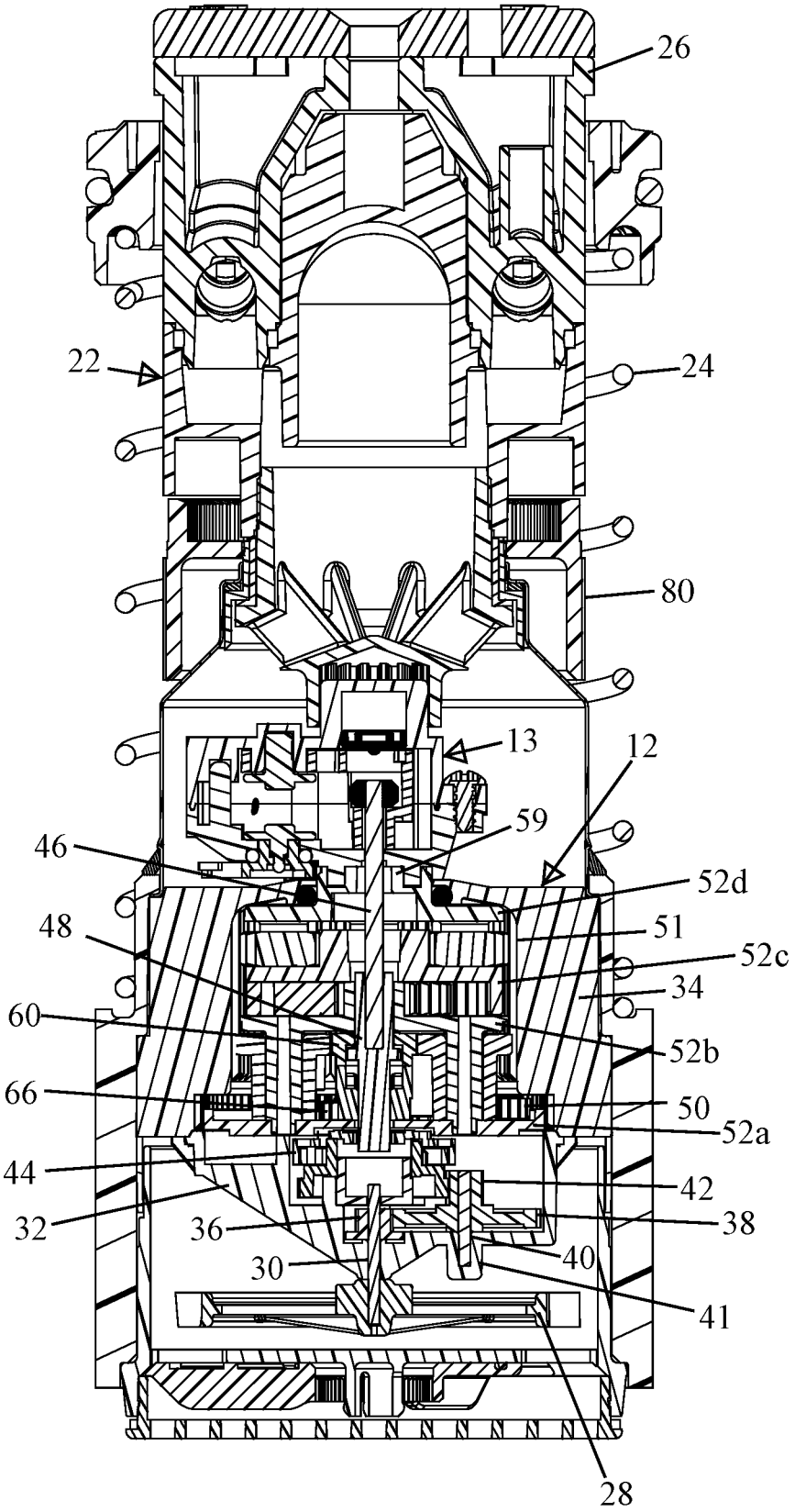
FIG. 2 is an enlarge view of the riser and nozzle turret of the sprinkler of FIG. 1.

Referring to FIG. 1A, in accordance with an embodiment of the present inventions a rotor-type sprinkler 10 incorporates a reversing planetary gear drive 12 (FIG. 2) that rotates or oscillates a nozzle 14 between pre-set arc limits. The sprinkler 10 shares some features similar to those disclosed in U.S. Pat. No. 6,491,235 of Scott et al. granted Dec. 10, 2002, the entire disclosure of which is hereby incorporated by reference. Some or all of the components of the sprinkler 10 can be generally made of injection molded plastic. The sprinkler 10 can be a so-called valve-in-head sprinkler that incorporates a valve 16 in the bottom of a cylindrical outer case 18 which is opened and closed by valve actuator components 19 contained in a housing 20 on the side of the case 18. The sprinkler 10 includes a generally tubular riser 22 (FIG. 2). A coil spring 24 normally holds the riser 22 in a retracted position within the outer case 18. The nozzle 14 is carried inside a cylindrical nozzle turret 26 rotatably mounted to the upper end of the riser 22. The coil spring 24 is compressible to allow the riser 22 and nozzle turret 26 to telescope from their retracted positions to their extended positions when pressurized water is introduced into the female threaded inlet at the lower end of the outer case 18.

FIG. 2 illustrates further details of the riser 22, nozzle turret 26 and reversing planetary gear drive 12. A turbine 28 is secured to the lower end of a vertically oriented drive input pinion shaft 30. The pinion shaft 30 extends through the lower cap 32 of a cylindrical gear box housing 34 of the reversing planetary gear drive 12. A turbine pinion gear 36 can be secured to the upper end of the pinion shaft 30. The turbine pinion gear 36 drives a lower spur gear 38 secured to a spur gear shaft 40. The lower end of the spur gear shaft 40 is journaled in a sleeve 41 integrally formed in the lower cap 32. Another pinion gear 42 is integrally formed on top of the spur gear 38 and drives an upper spur gear 44 of the reversing planetary gear drive 12. Thus the turbine 28 is coupled to an input stage of the planetary gear drive 12.

Figure 5:
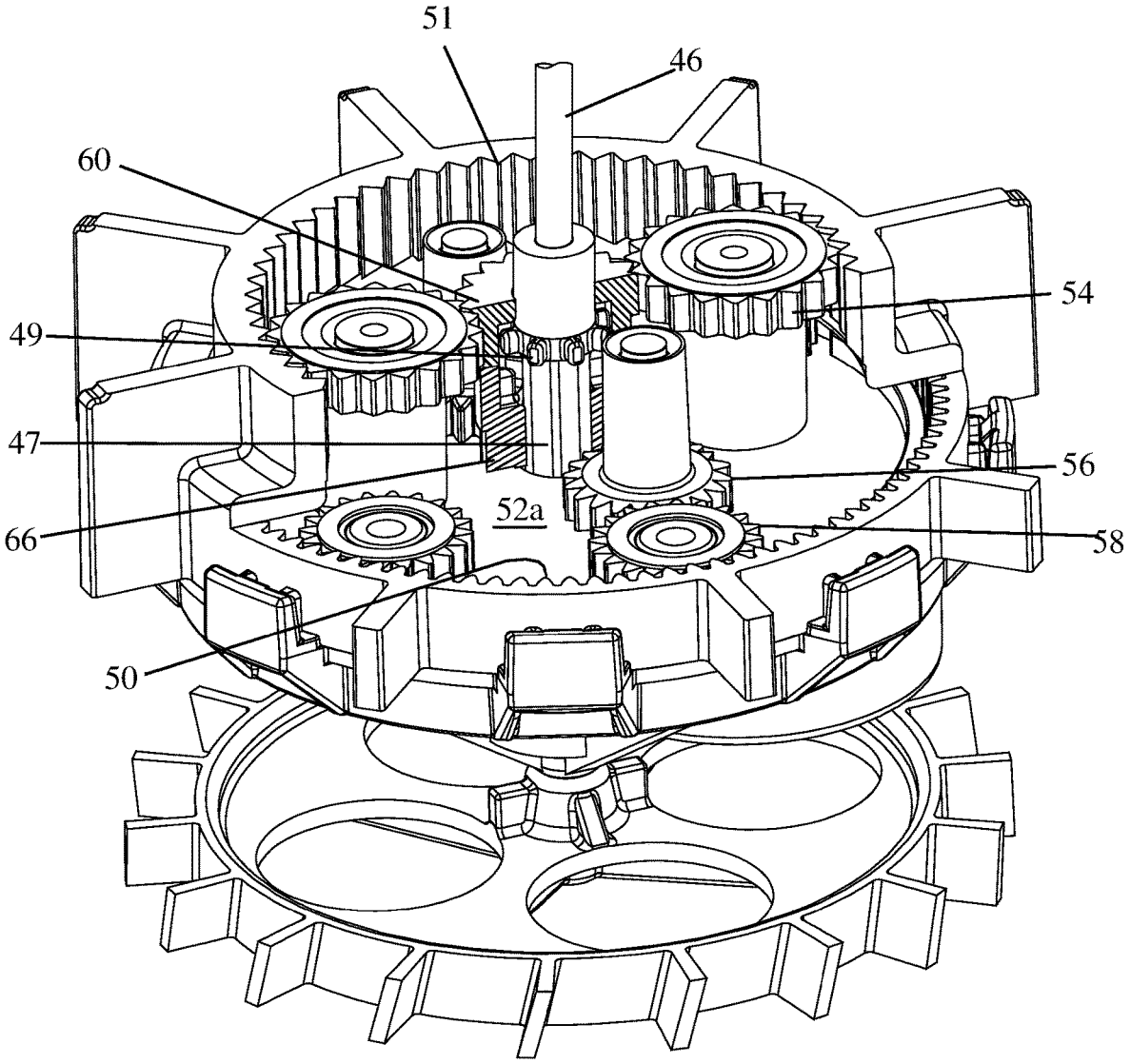
FIGS. 5 and 6 illustrate raised and lowered positions, respectively, of the shifting drive clutch control shaft and clutch.
Figure 6:
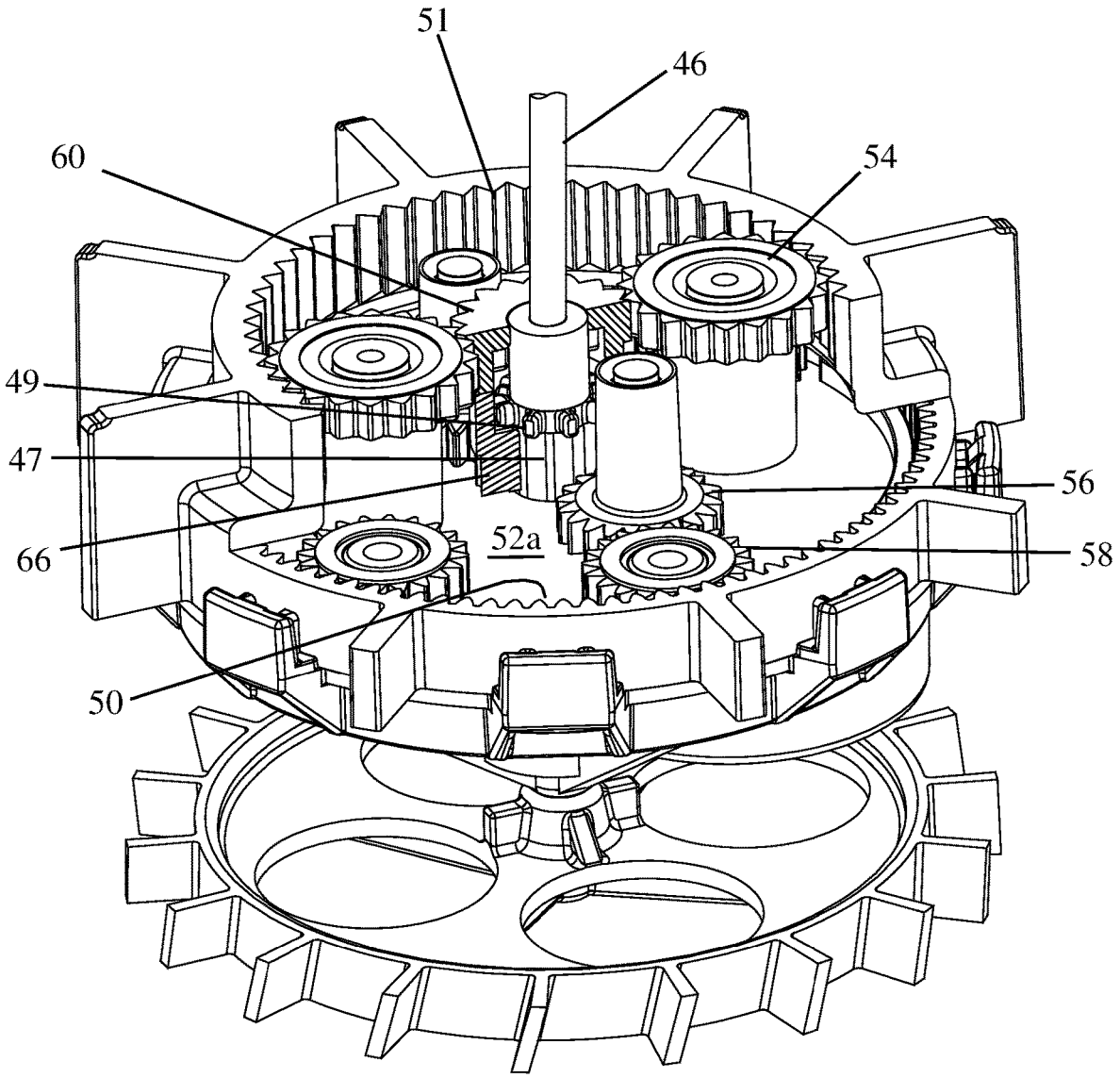
Figure 7:
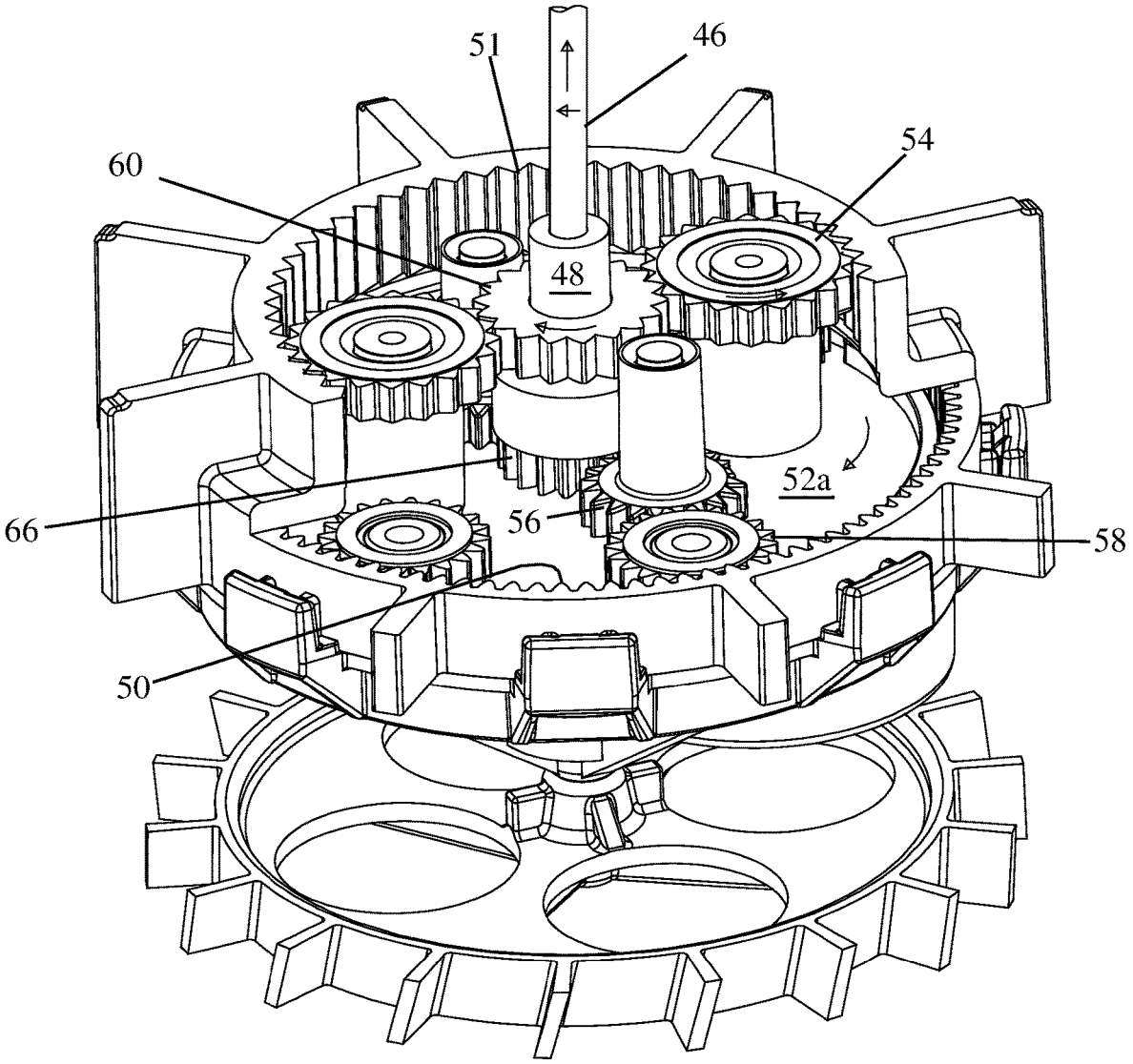
FIGS. 7 and 8 illustrate two different configurations of the shifting stage of the reversing planetary gear drive of FIG. 1 that cause the nozzle turret to rotate in opposite directions.

Referring still to FIG. 2, the reversing planetary gear drive 12 has a centrally located main control shaft 46. The lower end of the control shaft 46 is rigidly and co-axially coupled to a shifting drive clutch 48 which is vertically reciprocated by axial movement of the control shaft 46 between a raised state illustrated in FIG. 5 and a lowered state illustrated in FIG. 6. The interior wall of the cylindrical gear box housing 34 is formed with two axially displaced ring gears 50 and 51. Each of the ring gears 50 and 51 comprises a plurality of circumferentially spaced, vertically extending, radially inwardly projecting teeth that are engaged by the various planet gears of the reversing planetary gear drive 12. The lower ring gear 50 has a larger diameter and more teeth than the upper ring gear 51. The upper ring gear 51 has a larger axial length than the lower ring gear 50. Together the ring gears 50 and 51 form a bi-level ring gear.

Figure 3:
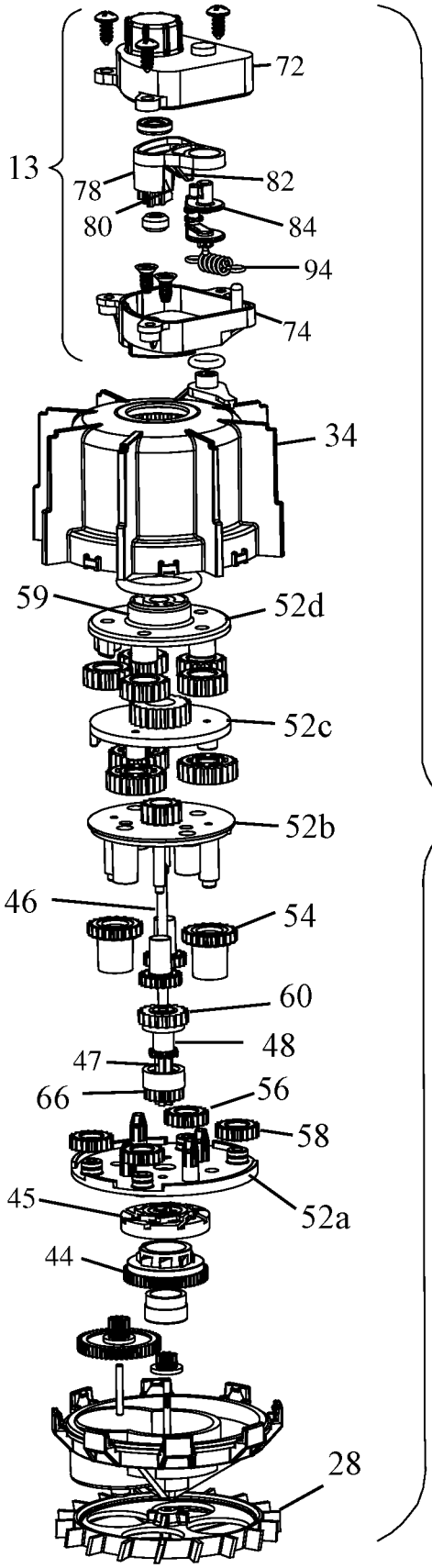
FIG. 3 is an exploded view of the reversing planetary gear drive and additional reversing mechanism of the sprinkler of FIG. 1.
Figure 4:
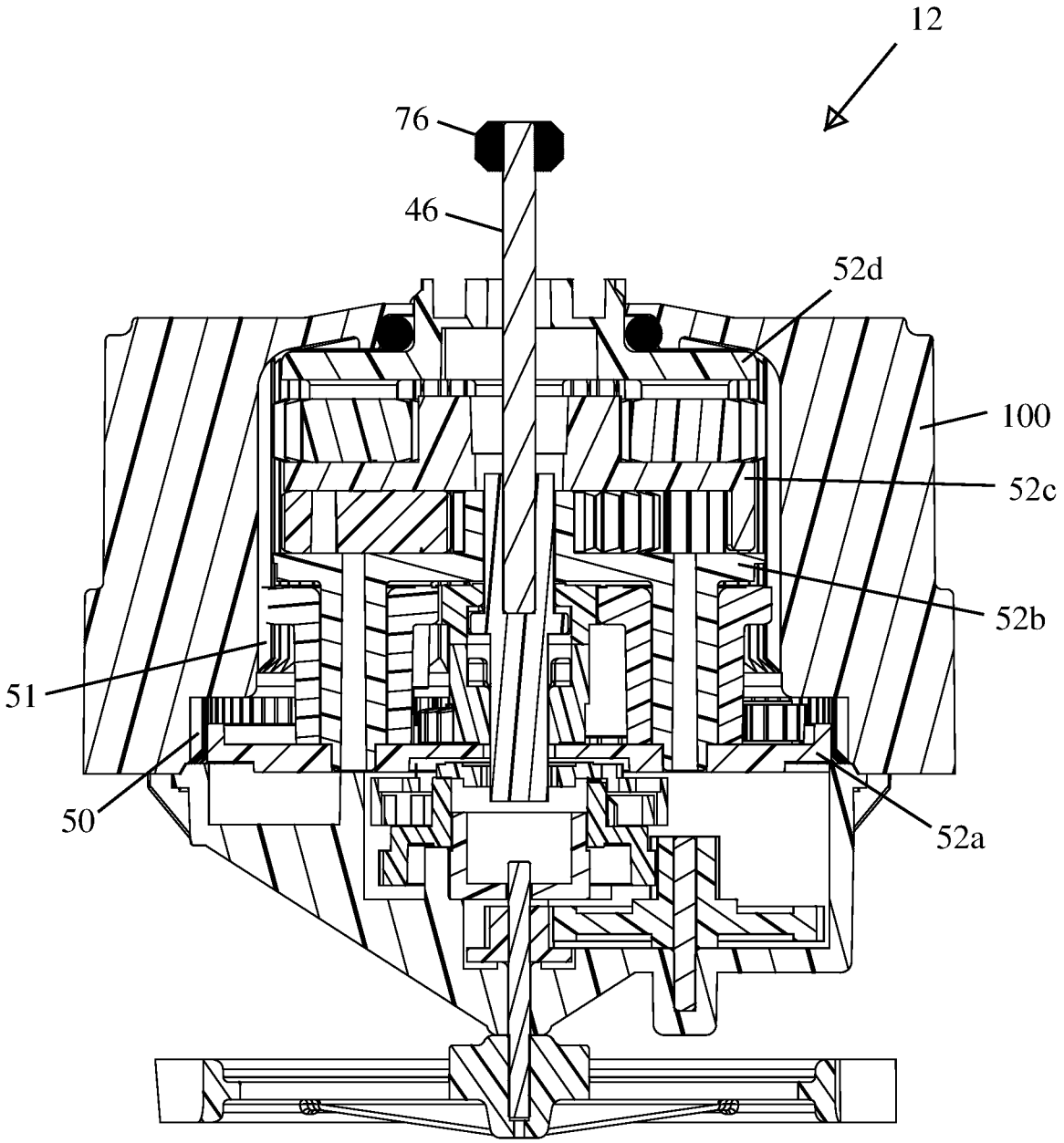
FIG. 4 is a sectioned view of a reversing planetary dear drive with an axial moving control shaft with a clutch that is engaged with one of two sun gears

Referring to FIGS. 3 and 4, the reversing planetary gear drive 12 includes a first disc-shaped stage carrier 52A, a second disc-shaped stage carrier 52B, a third disc-shaped stage carrier 52B, and/or a fourth disc-shaped stage carrier 52D. The stage carrier 52D functions as an output stage of the planetary gear drive 12. The carriers 52A, 52B, 52C and 52D rotate around the control shaft 46. A central spline opening (not illustrated) in the one way drive coupling 45 is drivingly coupled to a spline-shaped extension 47 of the shifting drive clutch 48 to allow for axial movement of the shifting drive clutch 48 relative to the upper spur gear 44. Thus the upper spur gear 44 continuously rotates the drive coupling 45, shifting drive clutch 48 and the control shaft 46 during vertical axial reciprocating movement of the control shaft 46 and the shifting drive clutch 48.

Figure 8:
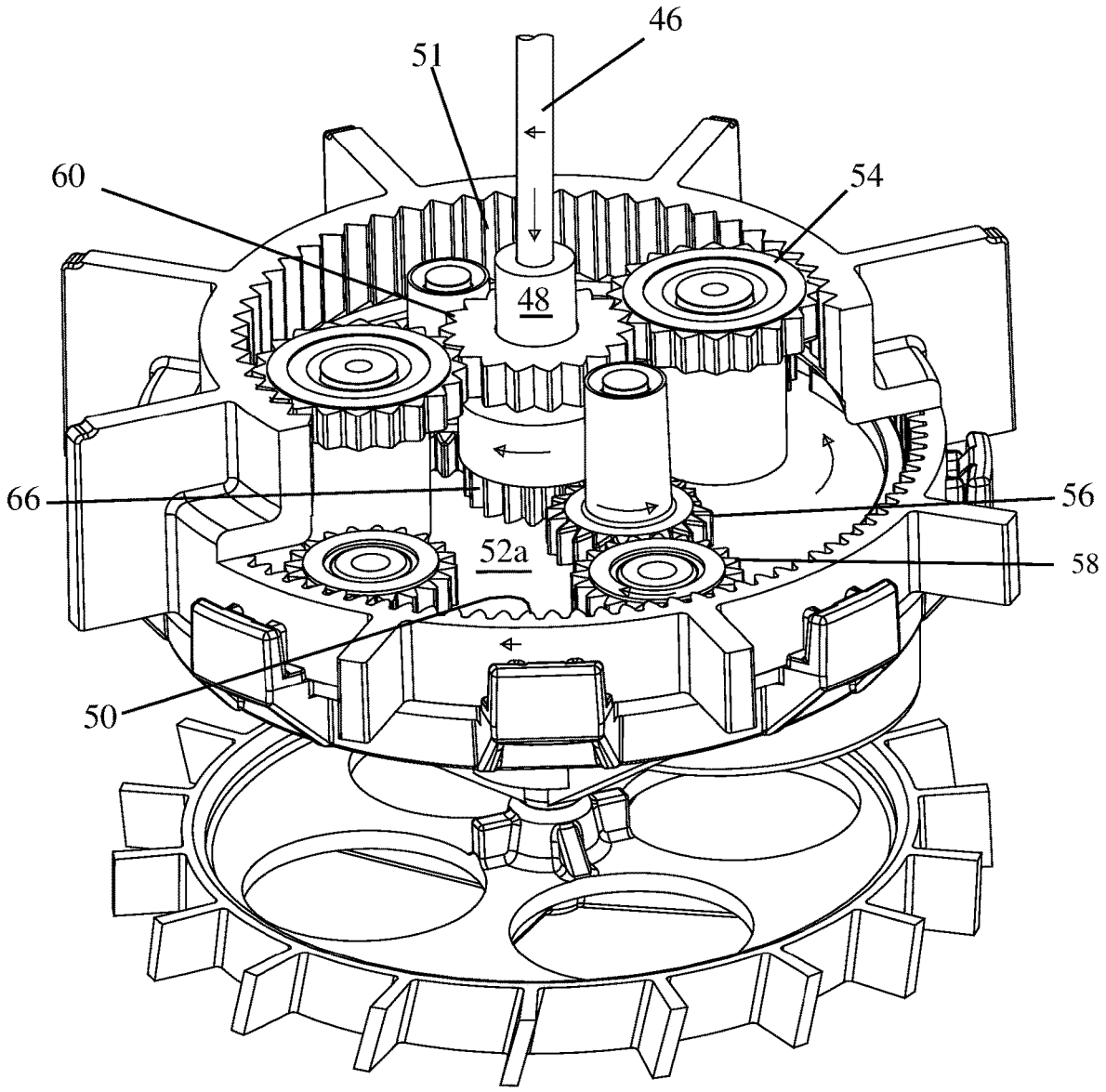
Figure 9:
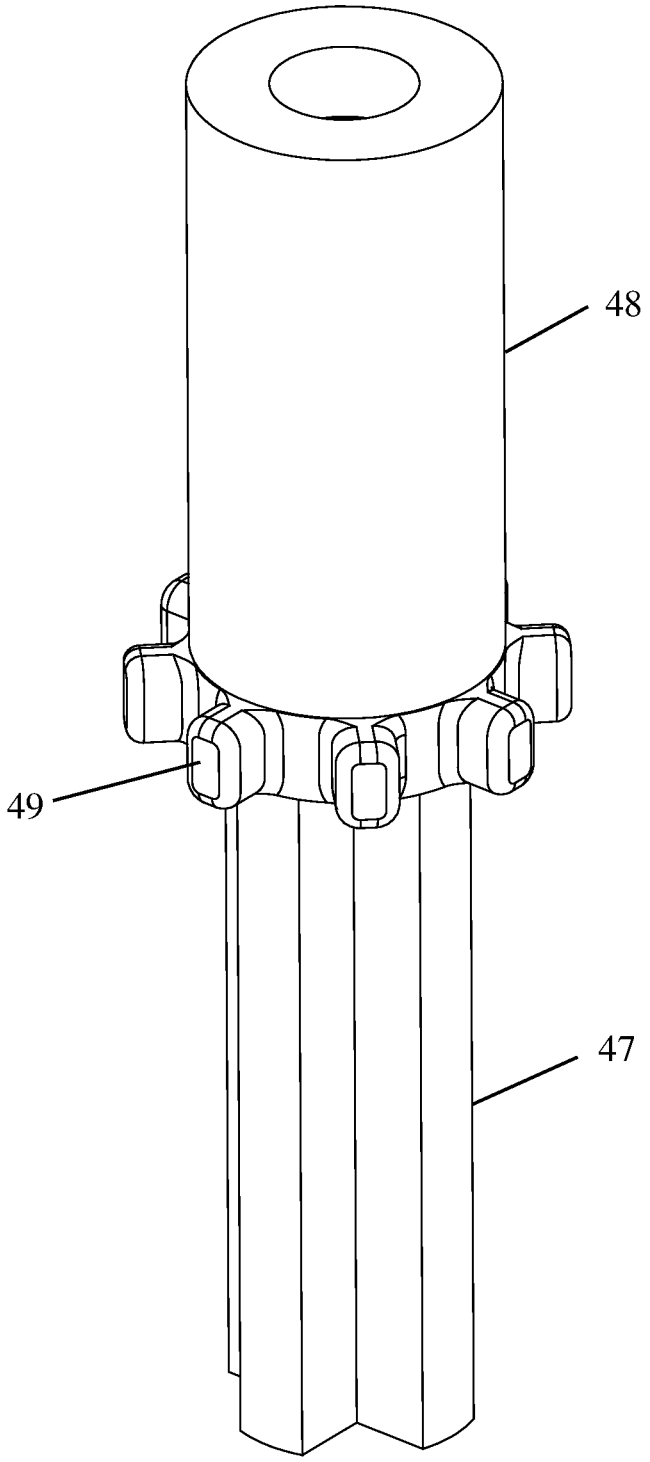
FIG. 9 illustrates the clutch of the control shaft.
Figure 10:
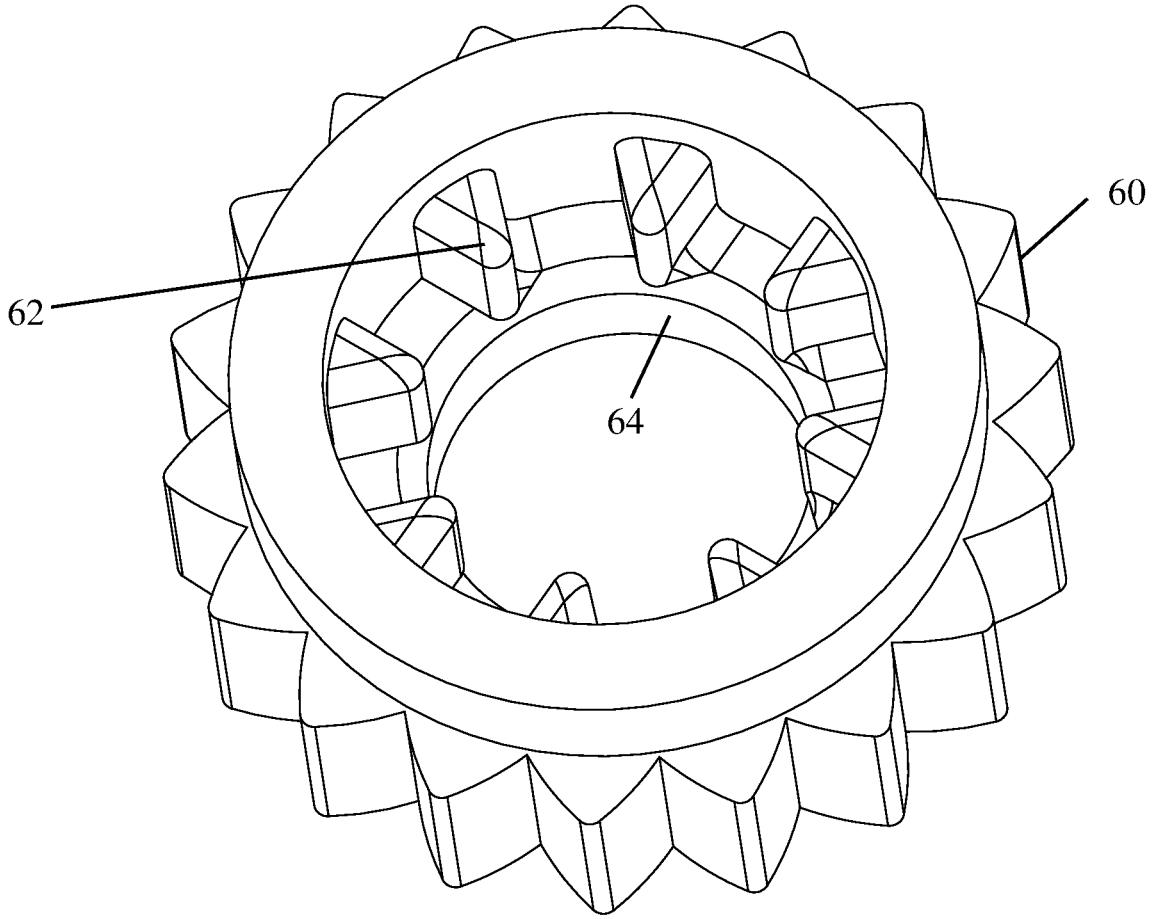
FIG. 10 illustrates the internal clutch teeth of the first drive gear.
Figure 11:
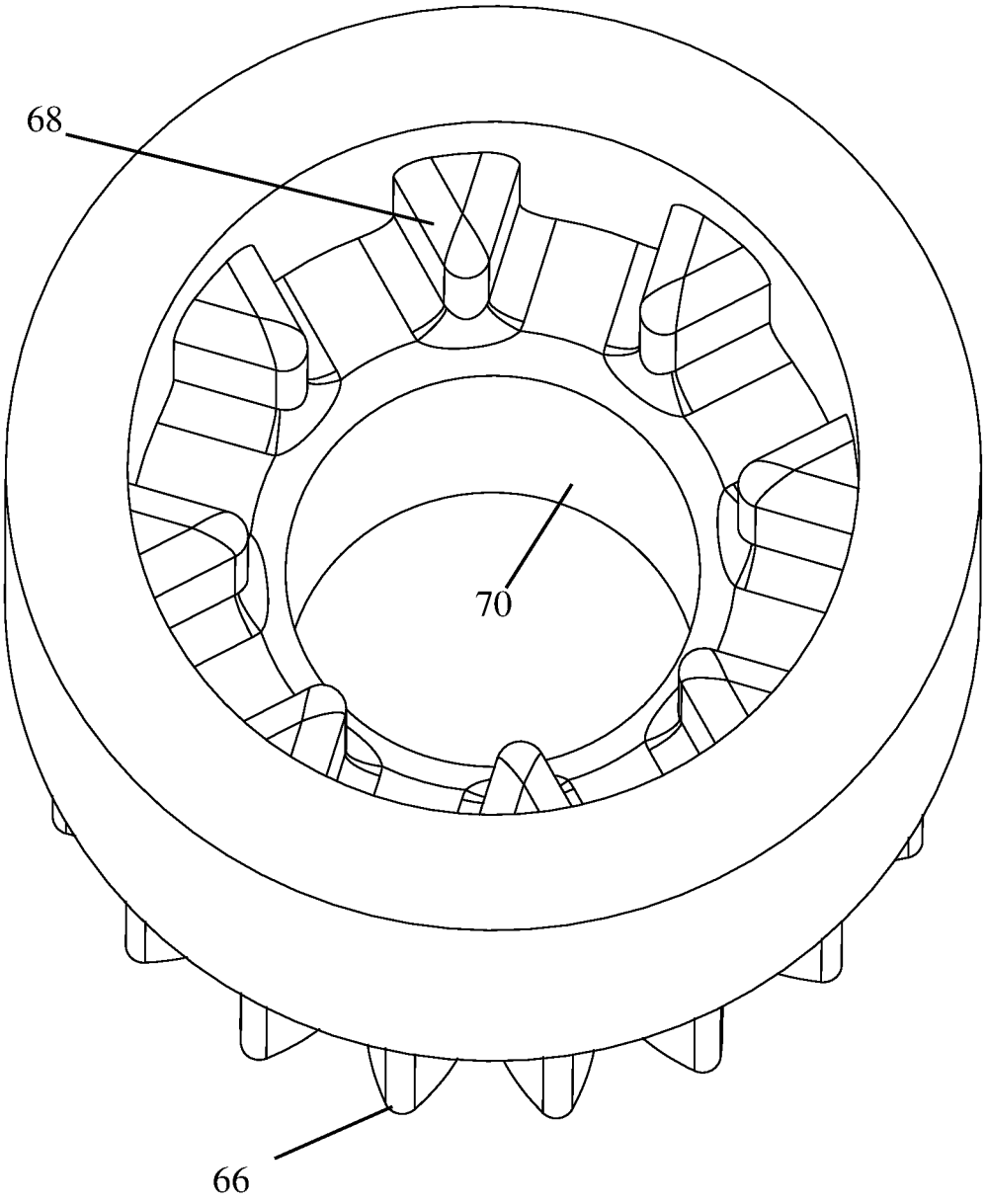
FIG. 11 illustrates the internal clutch teeth of the second drive gear.

When the shifting drive clutch 48 is in its raised state (FIGS. 2, 4, 5 and 7) the clutch dogs 49 (FIG. 9) thereof engage and mesh with complementary internal clutch teeth 62 (FIG. 10) of the upper drive gear 60. When the shifting drive clutch 48 is in its lowered state (FIGS. 6 and 8), the clutch dogs 49 thereof engage and mesh with internal clutch teeth 68 (FIG. 11) of the lower drive gear 66. The upper drive gear 60 meshes with the upper ring gear 51 (FIG. 5) formed on the interior wall of the gear box housing 34 thru the planet gear 54. The lower drive gear 66 engages the transfer gear 56 which engages another planet gear 58, which in turn engages the lower ring gear 50. The direction of rotation of the disc shaped gear carrier 52*a* changes from a first direction when the shifting clutch 48 is engaged with the upper drive gear 60 to a second direction when the shifting clutch 48 is engaged with the lower drive gear 66. The disc shaped carrier 52*b* is directly coupled to the disc shaped carrier 52*a*. Thus the direction of rotation subsequently carried through the remaining stages of the reversing planetary gear drive 12 is reversed by up and down movement of the control shaft 46 and the shifting drive clutch 48.

The shifting drive clutch 48 can have a neutral position between engagement with the upper drive gear 60 and with the lower drive gear 66 in which it is not engaged with either of these two gears. This can reduce the likelihood that the shifting drive clutch 48 will strip either or both of the clutch teeth 68 and 68. The shifting drive clutch 48 is configured to rotate as a result of the upstream rotating gears that are driven by the turbine 28. If the clutch dogs of the shifting drive clutch 48 do not immediately engage with the gears 60 and 68 during shifting, the clutch teeth 49 are configured to align within one tooth of rotation. In some embodiments, the shifting drive clutch 48 is biased both upwardly and downwardly from this neutral position (e.g., by an over-center spring mechanism inside the reversing mechanism 13). This can ensure that the planetary gear drive 12 will be in one of two driving states, either rotating the nozzle 14 clockwise or counter-clockwise.

The level of rotational torque on the planet gears 54 and 58 can be fairly low. In some embodiments, the meshing of the shifting drive clutch 48 with the drive gear 60 and the lower drive gear 66 is very smooth. The smooth shifting transition can be influenced by its position in the power transmission path of the planetary gear drive 12. The rotational speed of the turbine 28 is very high. If the shifting drive clutch 48 is placed too close to the turbine 28 in the power transmission path, the rotational speed of the shifting drive clutch 48 can be too fast, and shifting direction can be difficult as the clutch teeth 62 and 68 may tend to skip past the clutch dogs 49 instead of meshing smoothly. Likewise, the final output stage of the reversing planetary gear drive 12 generates substantial rotational torque. If the shifting drive clutch 48 is placed too close to the output stage (carrier 52D) in the power transmission path, the excessive torque can make it difficult for the clutch dogs 49 to slip axially across the faces of clutch teeth 62 and 68 and shifting may be difficult.

The reversing planetary gear drive 12 can include additional sun gears and planet gears which need not be described in detail as they will be readily understood by those skilled in the art of sprinkler design in view of FIGS. 2 and 3. The other planet gears also engage the ring gears 50 and 51 and rotate about corresponding fixed cylindrical posts that extend vertically from their associated disc-shaped carriers 52*a*, 52*b*, 52*c* and 52*d*. Each non-shifting sun gear can be secured to, and/or integrally formed with, one of the carriers 52*b*, 52*c* and 52*d*. The uppermost carrier 52*d* can have an upwardly projecting central section 59 (FIG. 2) that is coupled to the underside of the reversing mechanism 13 in order to rotate the same. The reversing mechanism 13 in turn supports and rotates the nozzle turret 26. With this arrangement of gears the high RPM of the turbine 28 is successively reduced so that the final output RPM of the control shaft 46 is relatively low, and the output torque at the central section 59 of the uppermost carrier 52*d* is relatively high. For example, the turbine 28 may rotate at speeds of greater than or less than eight hundred RPM and the output shaft 46 may rotate at an RPM of less than one, less than three, less than 5, less than 10, less than 25 and/or at some other reduced RPM.

In some embodiments, the sprinkler 10 uses the planetary gear drive 12 and the additional reversing mechanism 13 to change the direction of rotation of the nozzle turret 26. The overall reversing mechanism of the sprinkler 10 can have two portions, namely, the components of the reversing mechanism 13 that are located external of the gear box housing 34, and another portion that is contained within the planetary gear drive 12 that includes the shifting drive clutch 48, planetary gear 54, idler gear 56, and/or planetary gear 58. An advantage of including at least a portion of the overall reversing mechanism in the planetary gear drive 12 is that the shifting can be done in a low torque region of the planetary gear drive 12 where damage and wear to gears is much less likely to occur. This can reduce or eliminate the need to use conventional arc-shaped shifting frames with delicate pinion gears that engage a bull gear assembly and bear large loads. The planetary gear drive 12 can deliver relatively high rotational torque to the nozzle turret 26 in a manner that is useful in large rotor-type sprinklers used to water large areas such as golf courses and playing fields. Such high torque may prematurely wear out and/or strip conventional pivoting gear train reversing mechanisms. The different gear tooth profiles of the ring gears 50 and 51 and the upper and lower stages of the shifting drive clutch 48 desirably result in the nozzle 14 rotating in both the clockwise and counter-clockwise directions at a substantially uniform predetermined speed of rotation.

High output torque is important for large area sprinklers. Sprinklers of this type can discharge seventy-five gallons of water per minute at one-hundred and twenty PSI throwing water one hundred and fifteen feet from the sprinkler. Discharging water at this high rate creates substantial upward and radial forces on the nozzle turret 26 that results in significant drag and resistance to rotation of this component of a rotor-type sprinkler. The gear drives utilized in this type of sprinkler must overcome this resistance.

The fast spinning turbine 28 can slowly rotate the nozzle turret 26 through the reversing planetary gear drive 12 and the additional reversing mechanism 13. The additional reversing mechanism 13 includes cams and components that lift and drop the output shaft 46. An adjusting gear ring 80, carrier ring (not shown), and an adjusting gear (not shown) cooperate with the reversing mechanism 13 to permit user adjustment of the size of the arc of oscillation of the nozzle 14. To adjustment of the arc of coverage, the installer can turn the adjusting gear ring 80 by hand providing a direct one to one adjustment of the arc of coverage.

The reversing mechanism 13 includes an upper shift housing 72 (FIG. 3) and a lower shift housing 74 that mate to form a complete housing with a hollow interior that encloses most of the other components of the reversing mechanism 13 hereafter described. The reversing mechanism 13 further includes a shift member 76 (FIG. 4) that is rigidly secured to the upper end of the control shaft 46. The shift member 76 can be semi-spherical and/or barrel-shaped. In some cases, the shift member 76 is integrally formed with the control shaft 46. The reversing mechanism 13 can include a pivotable shift fork 78 (FIG. 3) with first and second spaced apart cams 80, 82. The first cam 80 can be configured with a sloped surface (not shown) that raises the control shaft 46 when the shift fork 78 is pivoted to engage the first cam with the shift member 76. The second cam 82 can be configured with an oppositely sloped surface that lowers the control shaft 46 when the shift fork 78 is pivoted to engage the second cam with the shift member 76.

The reversing mechanism 13 further includes a shift crank 84 (FIG. 3) that pivotally supports the shift fork 78 inside the joined upper and lower shift housings 72 and 74. An over-center coil spring 94 (FIG. 3) biases the shift fork 78 so that either the first cam 80 or the second cam 82 is engaged with the shift member 76. The over-center spring 94 has a first end connected to a post that extends from the lower shift housing 74 and a second end connected to a central segment of the shift crank 84. Additional details regarding the reversing mechanism 13 are disclosed in U.S. Pat. No. 8,955,768, entitled REVERSING MECHANISM FOR AN IRRIGATION SPRINKLER WITH REVERSING GEAR DRIVE, the entire disclosure of which is hereby incorporated by reference.

Figure 13:
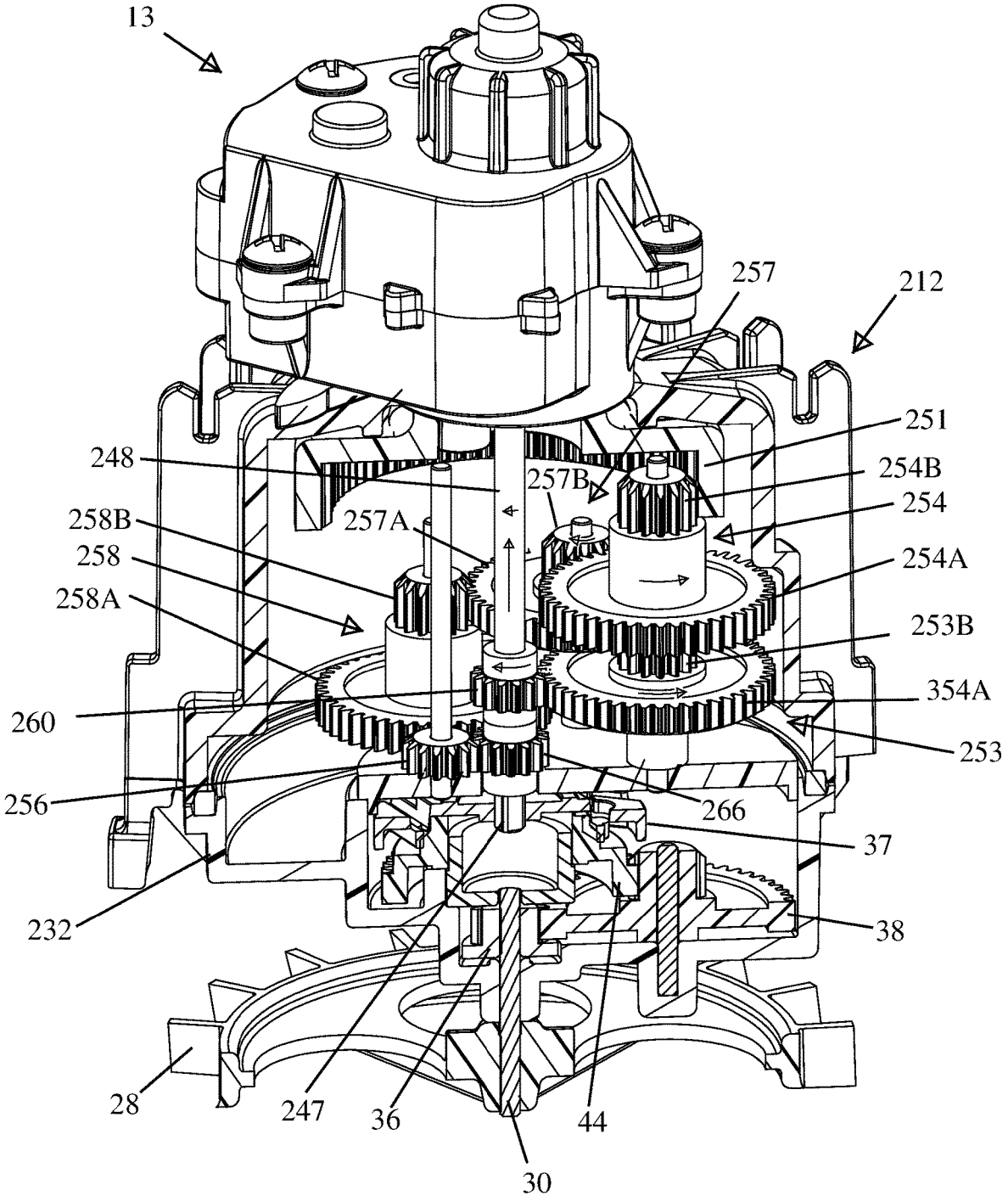
FIG. 13 illustrates the reversing gear drive of the sprinkler of FIG. 12 in a reverse operating configuration.
Figure 14:
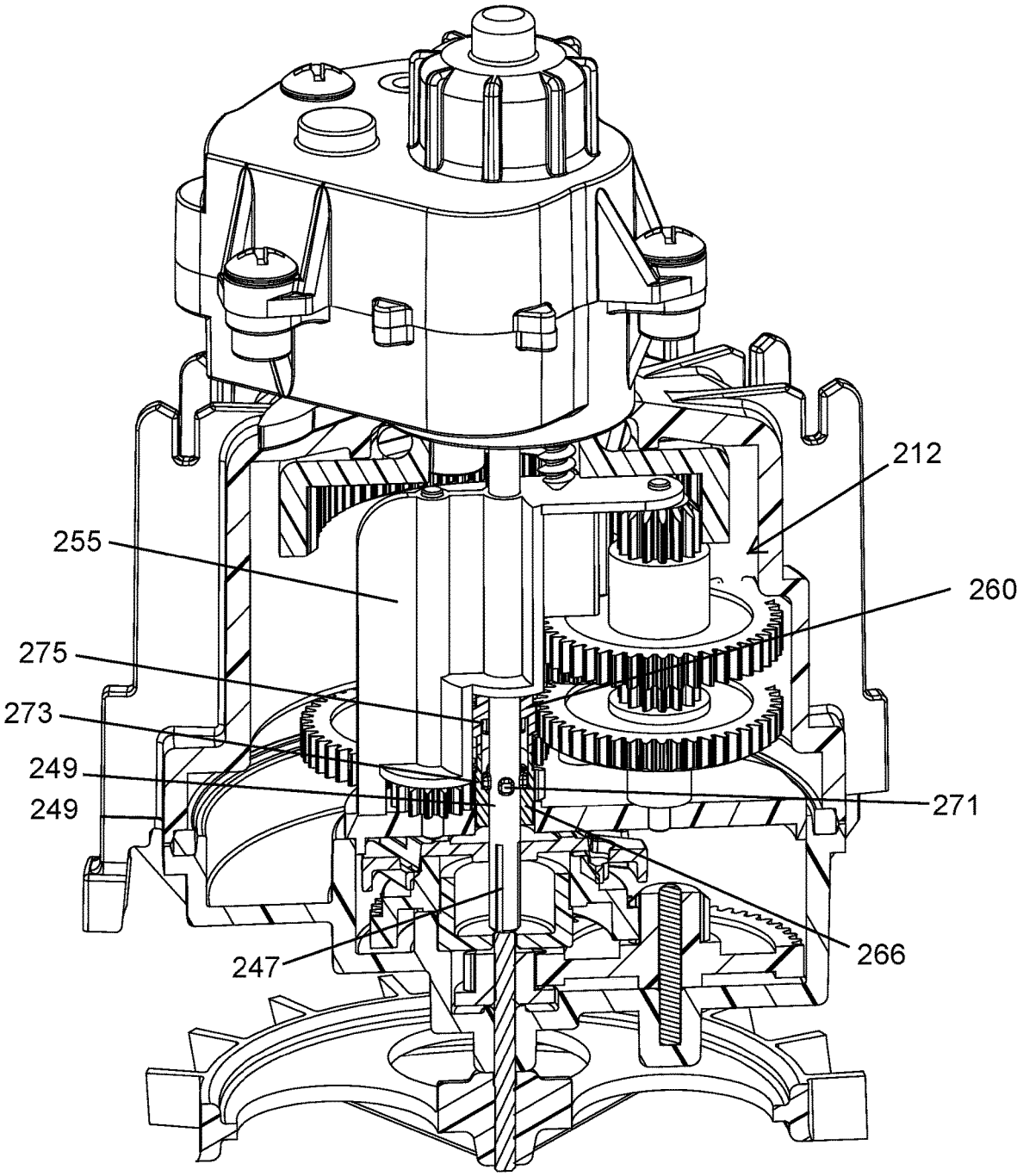
FIG. 14 illustrates the reversing gear drive of FIG. 12, wherein drive gears are partially sectioned to show a shifting clutch.

As illustrated in FIGS. 12-14, in some embodiments, the sprinkler utilizes a reversing gear drive 212 having a plurality of spur gears. The spur gears can be used in additional to or instead of one or more of the planetary gears described above.

Referring to FIG. 12, the reversing gear drive 212 can be operably connected to the turbine 28. The reversing gear drive 212 can be, for example, a reversing spur gear drive 212. The reversing gear drive 212 can be positioned between the turbine 28 and the reversing mechanism 13. The reversing gear drive 212 includes two alternately-engaged drive gears 260 and 266.

The alternately driven drive gears 260 and 266 can be alternately coupled to a shifting clutch 249 (FIG. 14). The shifting clutch 249 can share many or all of the characteristics of the clutch 49 described above, including, but not limited to, the dogs 49 (dogs 271 in FIG. 14) and the spline portion 47 (spline portion 247 in FIGS. 12-14). The shifting clutch 249 can be connected to and/or integrally formed with a drive shaft 248. The shifting clutch 249 can be rotatably connected to the turbine 28. For example, the shifting drive clutch 249 can be rotatably connected to the upper spur gear 44. In some embodiments, a clutch 37 is configured to selectively rotationally disconnect the shifting clutch 249 from the upper spur gear 44. The shifting drive clutch 249 can be spline-fit to the upper spur gear 44 and/or to the clutch 37 via the spline portion 247. The shifting drive clutch 249 can translate or shift axially (e.g., parallel to the drive input 30 shaft) with respect to the upper spur gear 44 and/or with respect to the clutch 37. In some configurations, the shifting drive clutch 249 shifts in a direction collinear with the drive input shaft 30. The shifting drive clutch 249 and shifting drive shaft 248 can have a similar or identical connection to the reversing mechanism 13 as described above with respect to the shifting drive clutch 48 and control shaft 46. For example, the shifting drive shaft 248 can be connected to a structure similar or identical to the shift member 76 described above.

As illustrated in FIGS. 12 and 13, the reversing gear drive 212 can be positioned within a gear box housing 234. The gear box housing 234 includes a lower cap 232 defining a lower wall of the gear box housing 234. In some embodiments, the reversing gear drive 212 includes a gear stage carrier **252*a*. The gear stage carrier 252*a* supports one or more of the gear stages within the reversing gear drive 212. For example, the gear stage carrier 252*a* can include one or more apertures configured to receive and/or support spline fittings, rotational shafts, and/or other components of the reversing gear drive 212. In some embodiments, the reversing gear drive 212 includes a gear support 255 (FIG. 14) configured to brace and support the gear stages (e.g., the gear shafts) of the reversing gear drive 212**.

FIG. 12 illustrates the reversing gear drive 212 in a forward operating configuration (e.g., a configuration wherein the nozzle turret 26 is rotated in the same direction of rotation as the shifting drive shaft 248). In the forward operating configuration, the shifting drive clutch 249 is in a lower position where clutch dogs 271 (e.g., similar to clutch dogs 49) meshes with the internal clutch teeth 273 (e.g., similar to clutch teeth 68) formed inside of a first drive gear 266. The drive gear 266 is always engaged with the idler gear 256. The idler gear 256 and drive gear 266 can have similar or identical diameters and/or the same number of gear teeth. The idler gear 256 engages with a first forward gear stage 258. The first forward gear state 258 engages with a second gear stage 257. The second gear stage 257 meshes and engages with a final gear stage 254. The final gear stage 254 meshes and engages with an output gear 251 (e.g., a ring gear). The output gear 251 rotationally engages with the reversing mechanism 13 (e.g., rotation of the output gear 251 rotates the reversing mechanism 13).

The first forward gear stage can include a first forward input gear 258*a* and a first forward output gear 258*b*. The first forward input gear 258*a* and/or the first forward output gear 258*b* can be spur gears. The idler gear 256 can mesh with the first forward input gear 258*a*. The first forward input gear 258*a* is rotationally coupled to (e.g., rotationally locked with) the first forward output gear 258*b*. For example, the first forward output gear 258*b* can be stacked with the first forward input gear 258*a* and rotationally locked thereto. In some embodiments, the first forward input gear 258*a* has a larger diameter and more teeth than the first forward output gear 258*b*.

In the illustrated embodiment, the first forward output gear 258*b* meshes with the second stage input gear 257*a*. The second stage input gear 257*a* is rotationally coupled to (e.g., rotationally locked with) to the second stage output gear 257*b*. For example, the second stage output gear 257*b* can be stacked with the second stage input gear 257*a* and rotationally locked thereto. The second stage input gear 257*a* and/or the second stage output gear 257*b* can be spur gears. In some embodiments, the second stage input gear 257*a* has a larger diameter and more teeth than the second stage output gear 257*b*.

The second stage output gear 257*b* is configured to mesh and engage with the final stage input gear 254*a*. The final stage input gear 254*a* is rotationally coupled to (e.g., rotationally locked with) to the final stage output gear 254*b*. For example, the final stage output gear 254*b* can be stacked with the final stage input gear 254*a* and rotationally locked thereto. In some embodiments, the final stage input gear 254*a* has a larger diameter and more teeth than the final stage output gear 254*b*. The final stage input gear 254*a* and/or the final stage output gear 254*b* can be spur gears. The final stage output gear 254*b* is configured to engage with the output gear 251. In the illustrated embodiment, the final stage output gear 254*b* is a spur gear and the output gear 251 is a ring gear.

FIG. 13 illustrates the reversing gear drive 212 in a reverse operating configuration (e.g., a configuration in which the nozzle turret 16 is rotated in a direction opposite that of the input gear 248). For example, the shifting drive clutch 249 can be shifted axially (e.g., upward) to engage the drive shaft clutch dogs with the internal teeth 275 (e.g., similar to clutch teeth 62) formed inside a second drive gear 260. In some embodiments, upward shifting of the shifting drive shaft 248 disengages the clutch dogs 271 from the first drive gear 266 and brings the clutch dogs of the shifting drive clutch 249 into engagement with the clutch teeth of second drive gear 260. The second drive gear 260 is always engaged with a first reversing gear stage 253. The first reversing gear stage 253 can engage with and rotate the second gear stage 257. The second gear stage 257 operates with the remaining gear stages (e.g., the final gear stage 254 and output gear 251) operate in substantially the same manner as discussed above with respect to the forward operating configuration. The first reversing gear stage 253 can include a first reversing input gear 253*a* and a first reversing output gear 253*b*. The first reversing input gear 253*a* and/or the first reversing output gear 253*b* can be spur gears. The input gear 248 can mesh with the first reversing input gear 253*a*. The first reversing input gear 253*a* is rotationally coupled to (e.g., rotationally locked with) the first reversing output gear 253*b*. For example, the first reversing output gear 253*b* can be stacked with the first reversing input gear 253*a* and rotationally locked thereto. In some embodiments, the first reversing input gear 253*a* has a larger diameter and more teeth than the first reversing output gear 253*b*.

While we have described and illustrated in detail embodiments of a sprinkler with a reversing gear drive, it should be understood that our inventions can be modified in both arrangement and detail. For example, the sprinkler 10 could be modified to a simplified shrub configuration without the valve 16, outer case 18, valve actuator components 19 and housing 20. Therefore the protection afforded our inventions should only be limited in accordance with the following claims.

What is claimed is:

1. A sprinkler comprising:

a turbine;

a nozzle;

a gear box case;

a planetary gear drive comprising:

a first sun gear having at least one first clutch tooth and being configured to rotate about a sun gear axis, a second sun gear having at least one second clutch tooth and being coaxially-aligned with the first sun gear, a first planetary gear meshed with the first sun gear and configured to rotate about a first planetary gear axis, and a second planetary gear configured to rotate about a second planetary gear axis and to be driven by the second sun gear;

a first gear carrier rotatable about the sun gear axis and configured to fix the first planetary gear axis and the second planetary gear axis in place with respect to each other; and a reversing mechanism rotatably coupling the turbine and the nozzle and having a drive shaft, the drive shaft having at least one clutch dog that is configured to reciprocate between a first position and a second position, the at least one clutch dog configured to alternately engage with the at least one first clutch tooth when in the first position and with the at least one second clutch tooth when in the second position to thereby change a direction of rotation of subsequent stages of the planetary gear drive.

2. The sprinkler of claim 1, comprising a riser enclosing the planetary gear drive, an outer case surrounding the riser, and a coil spring surrounding the riser and biased to hold the riser in a retracted position within the case, the coil spring being compressible to allow the riser to telescope to an extended position when pressurized water is introduced into the case.

3. The sprinkler of claim 2, wherein the nozzle is carried inside a nozzle turret rotatably mounted at the upper end of the riser.

4. The sprinkler of claim 1, wherein the reversing mechanism includes:

a shift member connected to the drive shaft;

a pivotable shift fork with a first cam and a second cam spaced from the first cam, the first cam configured to engage the shift member and raise the drive shaft when the shift fork is pivoted to engage the first cam with the shift member, the second cam configured to engage the shift member and lower the drive shaft when the first fork is pivoted to engage the second cam with the shift member; and a housing and a shift crank pivotally supporting the shift fork in the housing.

5. The sprinkler of claim 4, wherein the reversing mechanism further includes an over-center spring biasing the shift fork so that either the first cam or the second cam is engaged with the shift member.

6. The sprinkler of claim 5, wherein the over-center spring is a coil spring having a first end connected to the housing and a second end connected to the shift crank.

7. The sprinkler of claim 4, further comprising a shift toggle extending from the housing, the shift toggle being connected to the shift crank.

8. The sprinkler of claim 7, wherein the sprinkler further includes a fixed arc tab extending from a gear box housing of the planetary gear drive in a predetermined location so that the fixed arc tab can be engaged by the shift toggle as the housing is rotated by the planetary gear drive to pivot the shift fork to cause one of the first and second cams to engage the shift member.

9. The sprinkler of claim 7, wherein the sprinkler further comprises a turret carrying the nozzle, a ring coupled to the turret and rotatable relative to the housing, a bull gear ring coupled to the ring, and an adjustable arc tab extending from the ring in a predetermined location so that the adjustable arc tab can be engaged by the shift toggle as the housing is rotated by the planetary gear drive to pivot the shift fork to cause the other one of the first and second cams to engage the shift member.

10. The sprinkler of claim 1, wherein the gear box case comprises the first gear carrier.

11. The sprinkler of claim 1, wherein the gear box case comprises at least one ring gear.

12. The sprinkler of claim 1, further comprising an idler gear positioned between the second sun gear and the second planetary gear.

13. The sprinkler of claim 1, further comprising a second gear carrier coupled to the first gear carrier.

14. The sprinkler of claim 13, wherein the first sun gear and the second sun gear are positioned between the first gear carrier and the second gear carrier.

15. The sprinkler of claim 1, wherein the at least one clutch dog is configured to pass through a neutral position when transitioning between engagement with the first sun gear and the second sun gear, and wherein the at least one clutch dog is engaged with neither the first sun gear nor the second sun gear when in the neutral position.

16. A sprinkler comprising:

a turbine;

a nozzle;

a planetary gear drive assembly comprising:

a first planet gear configured to rotate about a first planet gear axis, a first sun gear having at least one first clutch tooth, the first sun gear being configured to be in constant engagement with the first planet gear and to rotate about a sun gear axis, a second planet gear configured to rotate about a second planet gear axis, an idler gear configured to be in constant engagement with the second planet gear and to rotate about an idler gear axis, and a second sun gear having at least one second clutch tooth, the second sun gear being configured to be in constant engagement with the idler gear and being coaxially-aligned with the first sun gear; and a reversing mechanism rotatably coupling the turbine and the nozzle and having a drive shaft, the drive shaft having at least one clutch dog that is configured to reciprocate between a first position and a second position, the at least one clutch dog configured to alternately engage with the at least one first clutch tooth when in the first position and with the at least one second clutch tooth when in the second position to thereby change a direction of rotation of subsequent stages of the planetary gear drive assembly.

17. The sprinkler of claim 16, wherein the first sun gear comprises an internal cavity, wherein the second sun gear comprises an internal cavity in communication with the internal cavity of the first sun gear, and wherein the at least one clutch dog is configured to move within the internal cavities of both the first sun gear and the second sun gear when moving between the first position and the second position.

18. The sprinkler of claim 16, wherein the at least one clutch dog is configured to drive rotation of the nozzle in a first direction when the at least one clutch dog is in the first position, and to drive rotation of the nozzle in a second direction opposite the first direction when the at least one clutch dog is in the second position.

19. The sprinkler of claim 16, wherein each of the first planet gear axis, the sun gear axis, and idler gear axis are parallel to each other, and wherein respective distances between each of the first planet gear axis, the sun gear axis, and idler gear axis are fixed in a direction perpendicular to the sun gear axis.

20. A sprinkler comprising:

a turbine;

a nozzle;

a gear drive assembly comprising:

a first driving gear having at least one first clutch tooth and being configured to rotate about a first gear axis, a second driving gear having at least one second clutch tooth and being coaxially-aligned with the first driving gear, a first driven gear meshed with the first driving gear and configured to rotate about a second gear axis, wherein the second gear axis is parallel to the first gear axis, and a second driven gear meshed with the second driving gear and configured to rotate about a third gear axis, wherein the third gear axis is parallel to the first gear axis; and a reversing mechanism rotatably coupling the turbine and the nozzle and having a drive shaft, the drive shaft having at least one clutch dog that is configured to reciprocate between a first position and a second position, the at least one clutch dog configured to alternately engage with the at least one first clutch tooth when in the first position and with the at least one second clutch tooth when in the second position to thereby change a direction of rotation of subsequent stages of the gear drive assembly.

* * * * *